US010240428B2

(12) United States Patent
Eldho

(10) Patent No.: US 10,240,428 B2
(45) Date of Patent: Mar. 26, 2019

(54) PACKER ASSEMBLY WITH THERMAL EXPANSION BUFFERS AND ISOLATION METHODS

(71) Applicant: Halliburton Energy Services, Inc., Houston, TX (US)

(72) Inventor: Shanu Thottungal Eldho, Hougang (SG)

(73) Assignee: Halliburton Energy Services, Inc., Houston, TX (US)

( * ) Notice: Subject to any disclaimer, the term of this patent is extended or adjusted under 35 U.S.C. 154(b) by 439 days.

(21) Appl. No.: 14/655,321

(22) PCT Filed: May 29, 2014

(86) PCT No.: PCT/US2014/039957

§ 371 (c)(1),
(2) Date: Jun. 24, 2015

(87) PCT Pub. No.: WO2015/183277

PCT Pub. Date: Dec. 3, 2015

(65) Prior Publication Data

US 2016/0258245 A1 Sep. 8, 2016

(51) Int. Cl.

| | |
|---|---|
| ***E21B 33/128*** | (2006.01) |
| ***E21B 29/00*** | (2006.01) |
| ***E21B 33/12*** | (2006.01) |
| ***E21B 33/129*** | (2006.01) |
| ***E21B 23/06*** | (2006.01) |

(52) U.S. Cl.

CPC ..... *E21B 33/128* (2013.01); *E21B 23/06* (2013.01); *E21B 29/00* (2013.01); *E21B 33/12* (2013.01); *E21B 33/1208* (2013.01); *E21B 33/129* (2013.01); *E21B 33/1293* (2013.01)

(58) Field of Classification Search

CPC .. E21B 33/128; E21B 33/12; E21B 33/12293; E21B 33/1216; E21B 33/129; E21B 33/1295; E21B 33/1208; E21B 23/06; E21B 29/00

USPC ..... 166/376

See application file for complete search history.

(56) References Cited

U.S. PATENT DOCUMENTS

| | | | | |
|---|---|---|---|---|
| 3,976,133 | A | 8/1976 | Allen | |
| 5,467,819 | A * | 11/1995 | Braddick | E21B 7/061 166/117.6 |
| 8,695,714 | B2 * | 4/2014 | Xu | E21B 33/134 166/118 |
| 2007/0125532 | A1 | 6/2007 | Murray et al. | |

(Continued)

OTHER PUBLICATIONS

International Search Report and Written Opinion of PCT Application No. PCT/US2014/039957 dated Feb. 26, 2015: pp. 1-17.

*Primary Examiner* — Nicole Coy
*Assistant Examiner* — Tara E Schimpf
(74) *Attorney, Agent, or Firm* — Chamberlain Hrdlicka

(57) ABSTRACT

Systems, methods, and apparatuses for accommodating thermal expansion in a tool string are disclosed. Exemplary systems include one or more sacrificial members placed between or adjacent elements of the tool string that are expected to expand when subjected to high temperatures. The sacrificial members are configured to destruct upon exposure to a control signal or a critical temperature or load. Destruction of the sacrificial members provides additional clearance for adjacent elements to expand.

16 Claims, 3 Drawing Sheets

(56) References Cited

U.S. PATENT DOCUMENTS

| | | | | |
|---|---|---|---|---|
| 2007/0163777 | A1* | 7/2007 | Murray | E21B 33/1216 166/179 |
| 2007/0205001 | A1* | 9/2007 | Shuster | B21D 39/04 166/380 |
| 2008/0099209 | A1 | 5/2008 | Loretz et al. | |
| 2009/0090563 | A1* | 4/2009 | Voronin | B22F 7/06 175/434 |
| 2012/0292053 | A1 | 11/2012 | Xu et al. | |
| 2014/0332233 | A1* | 11/2014 | Walton | E21B 33/1208 166/376 |
| 2015/0308206 | A1* | 10/2015 | Yue | E21B 23/06 166/387 |
| 2015/0330191 | A1* | 11/2015 | Holderman | E21B 43/12 166/205 |

* cited by examiner

PACKER ASSEMBLY WITH THERMAL EXPANSION BUFFERS AND ISOLATION METHODS

1. FIELD OF THE INVENTION

The disclosure relates to oil and gas exploration and production, and more particularly, to a packer assembly having sacrificial elements to account for thermal expansion of the assembly.

2. DESCRIPTION OF RELATED ART

Crude oil and natural gas occur naturally in subterranean deposits and their extraction includes drilling a well. The well provides access to a production fluid that often contains crude oil and natural gas. Generally, drilling of the well involves deploying a drill string into a formation. The drill string includes a drill bit that removes material from the formation as the drill string is lowered to form a wellbore. After drilling and prior to production, a casing may be deployed in the wellbore to isolate portions of the wellbore wall and prevent the ingress of fluids from parts of the formation that are not likely to produce desirable fluids. After completion, a production string may be deployed into the well to facilitate the flow of desirable fluids from producing areas of the formation to the surface for collection and processing.

A variety of packers and other tools may operate in the wellbore to fix the production string relative to a casing or wellbore wall, and may also function isolate production zones of the well so that hydrocarbon-rich fluids are collected from the wellbore in favor of undesirable fluids (such as water). These packers and tools may operate in a wide variety of downhole environments, including extreme downhole environments having very high pressures and very high temperatures of up to, for example, 30 ksi and 450° F.

BRIEF DESCRIPTION OF THE DRAWINGS

The accompanying drawings, which are included to provide a further understanding of the disclosure and are incorporated in and constitute a part of this specification, illustrate preferred embodiments of the disclosure and together with the detailed description serve to explain the principles of the disclosure. In the drawings.

DETAILED DESCRIPTION OF ILLUSTRATIVE EMBODIMENTS

Figure 1:
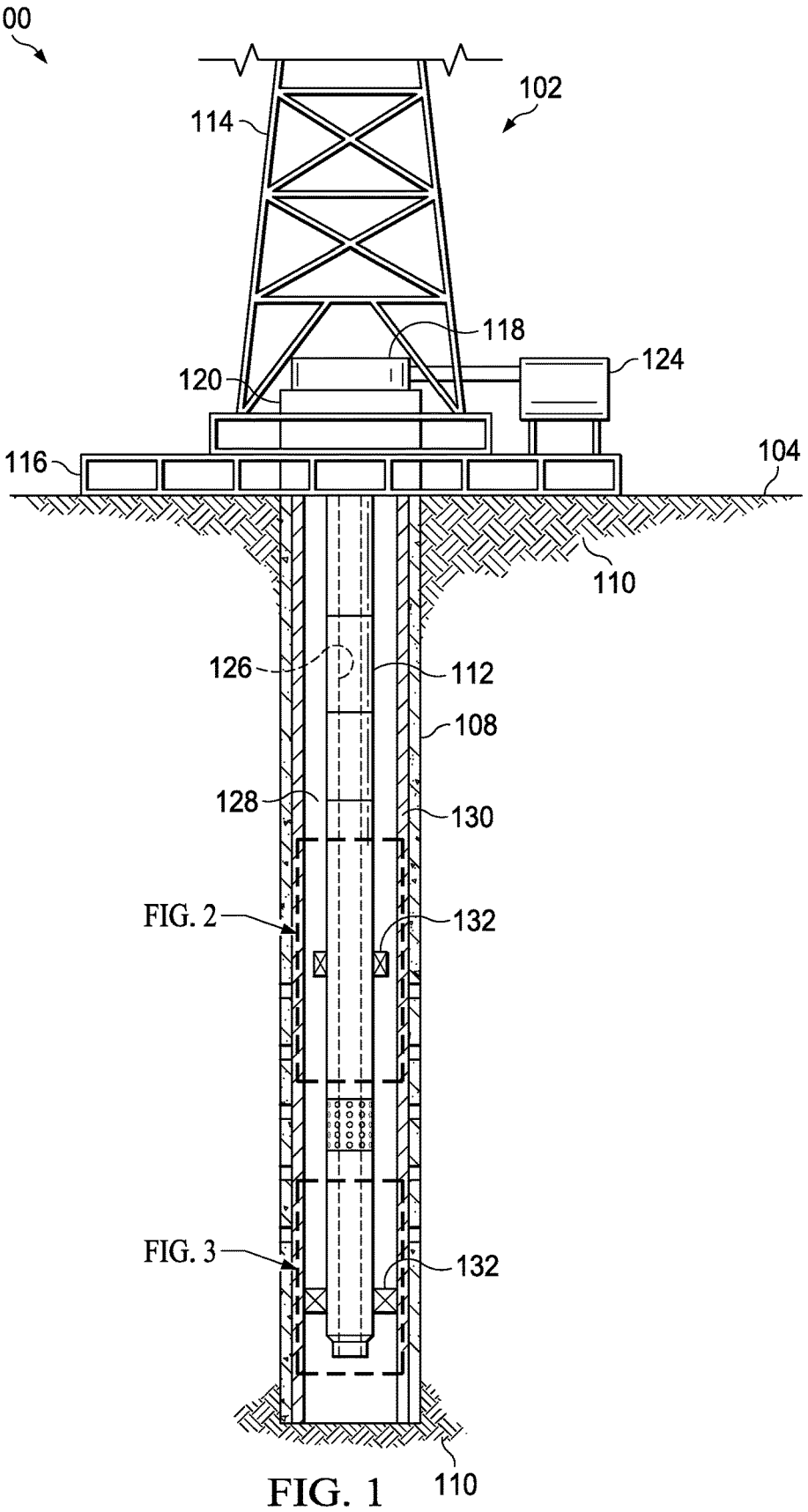
FIG. 1 is a schematic, elevation view with a portion shown in cross-section of an illustrative embodiment of a well in which a packer assembly shown in a deployed state in a lower zone and an undeployed state in an upper zone, according to one embodiment.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

In the drawings and description that follow, like parts are typically marked throughout the specification and drawings with the same reference numerals or coordinated numerals. The drawing figures are not necessarily to scale. Certain features of the invention may be shown exaggerated in scale or in somewhat schematic form and some details of conventional elements may not be shown in the interest of clarity and conciseness.

As noted above, a variety of packers and other tools may operate in the wellbore to fix the production string relative to a casing or wellbore wall, and may also function to isolate production zones of the well so that hydrocarbon-rich fluids are collected from the wellbore in favor of undesirable fluids (such as water). As such, systems that include the packers or packer assemblies described herein may be referred to as isolation systems. Packers and isolation systems are common components in a completion tool string and are used to provide a seal between the outside of the tubing that forms the production string and a wellbore wall or an interior surface of a casing or liner. In some wells, the packers may be subject to extreme conditions. For example, wells have been known to reach pressures of up to 30 ksi and temperatures of up to 450° F.

The materials that make up a completion string, including the packer or packer assembly, may experience loads and deformation as a result of the wellbore conditions. Elements of the packer assembly that move to actuate the packer may be arranged in the axial direction of the production string such that triggering of an actuator causes elements to move toward one another, thereby (for example) compressing expandable materials and causing them to expand in a radial direction or engaging a cam surface to cause components of the packer to extend in the radial direction form a seal against the wellbore wall or well casing.

High temperatures in the well may cause materials to expand prior to engagement of the actuator, and the resulting thermal expansion of elements may result in compressive loads being generated within the drill string. The compressive loads may result in buckling or deformation that causes displacement of certain elements of the packer, which may in some cases cause premature actuation of the packer.

To compensate for the unintended loads that may be generated as a result of thermal expansion, a packer assembly is disclosed that includes sacrificial members disposed between elements that interact upon actuation of the packer. The sacrificial members are configured to destruct by melting, collapse, or disintegration upon exposure to a critical temperature or a selected axial load.

In an embodiment, the sacrificial members help to maintain the integrity of the packer assembly as the production string is deployed in the wellbore by reinforcing elements of the packer and preventing undesired displacement. As the temperature of the production string at the location of the packer assembly increases and components begin to experience thermal expansion, destruction of the sacrificial members may provide a void that is approximately equivalent to the total thermal expansion of packer assembly elements that are arranged in line along the axial direction of the production string (in parallel to the axis of the production string) so that the packer assembly will not experience undesired loading or excessive compressive forces that may result in premature actuation of the packer.

Packer assemblies and other wellbore components that include such sacrificial members, along with systems and methods related thereto are described in more detail with regard to the figures discussed below. That said, it is noted that while the operating environment shown in FIG. 1 relates to a stationary, land-based rig for raising, lowering, and setting a production tool string 112, in alternative embodiments, mobile rigs, wellbore servicing units (e.g., coiled tubing units, slickline units, or wireline units), and the like may be used to lower the production tool string 112. Furthermore, while the operating environment is generally discussed as relating to a land-based well, the systems and methods described herein may instead be operated in subsea well configurations accessed by a fixed or floating platform.

The benefits and advantages described above may relate to one embodiment or may relate to several embodiments. Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity. It will further be understood that reference to "a" or "an" item refers to one or more of those items.

The steps of the methods described herein may be carried out in any suitable order or simultaneous where appropriate. Where appropriate, aspects of any of the examples described above may be combined with aspects of any of the other examples described to form further examples having comparable or different properties and addressing the same or different problems.

The various characteristics mentioned above, as well as other features and characteristics described in more detail below, will be readily apparent to those skilled in the art with the aid of this disclosure upon reading the following detailed description of the embodiments, and by referring to the accompanying drawings. Other means may be used as well.

Referring now to FIG. 1, an illustrative embodiment of a production system 100 that includes a packer assembly 132 having sacrificial elements is presented. The production system 100 includes a rig 102 atop a surface 104 of a well 106. Beneath the rig 102, a wellbore 108 is formed within a geological formation 110, which is expected to produce hydrocarbons. The wellbore 108 may be formed in the geological formation 110 using a drill string that includes a drill bit to remove material from the geological formation 110. The wellbore 108 of FIG. 1 is shown as being near-vertical, but may be formed at any suitable angle to reach a hydrocarbon-rich portion of the geological formation 110. In some embodiments, the wellbore 108 may follow a vertical, partially-vertical, angled, or even a partially-horizontal path through the geological formation 110.

A production tool string 112 is deployed from the rig 102, which may be a drilling rig, a completion rig, a workover rig, or another type of rig. The rig 102 includes a derrick 114 and a rig floor 116. The production tool string 112 extends downward through the rig floor 116, through a fluid diverter 118 and blowout preventer 120 that provide a fluidly sealed interface between the wellbore 108 and external environment, and into the wellbore 108 and geological formation 110. The production tool string is shown in installed position in FIG. 1. However, prior to or following installation, the production system 100 may also include a motorized winch and other equipment for extending the production tool string 112 into the wellbore 108, retrieving the production tool string 112 from the wellbore 108, positioning the production tool string 112 at a selected depth within the wellbore 108, or for lowering diagnostic, repair, or other equipment into the production tool string 112 by (for example) wireline or slickline.

A pump 124 is coupled to the fluid diverter. The pump 124 is operational to deliver or receive fluid through a fluid bore 126 of the production tool string 112 by applying a positive or negative pressure to the fluid bore 126. As referenced herein, the fluid bore 126 is the flow path of fluid from an inlet of the production tool string 112 to the surface 104. The pump 124 may also deliver positive or negative pressure through an annulus 128 formed between the wall of the wellbore 108 and exterior of the production tool string 112. The annulus 128 is formed between the production tool string 112 and a wellbore casing 130 when production tool string 112 is disposed within the wellbore 108. As referenced herein, the term "casing" may be used interchangeably with the term "liner" to indicate tubing that is used to line or otherwise provide a barrier along a wellbore wall. Such casings may be fabricated from composites, metals, plastics, or any other suitable material.

Following formation of the wellbore 108, the production tool string 112 may be equipped with tools and deployed within the wellbore 108 to prepare, operate, or maintain the well 106. Specifically, the production tool string 112 may incorporate tools that are hydraulically-actuated after deployment in the wellbore 108, including without limitation bridge plugs, composite plugs, cement retainers, high expansion gauge hangers, straddles, or packers. Any components of the production tool string that requires elements for sealing may benefit from use of the concepts of the present invention. As such, any elements that expand and form a seal can use sacrificial members as described herein. Actuation of such tools may result in centering the production tool string 112 within the wellbore 108, anchoring the production tool string 112, isolating a segment or zone of the wellbore 108 from other segments or zones, or other functions related to positioning and operating the production tool string 112. In the illustrative embodiment shown in FIG. 1, the production tool string 112 is depicted with packers 132 for isolating segments of the wellbore 108. Packers 132, 134 are typically used to prepare the wellbore 108 for hydrocarbon production (e.g., fracturing) or for service during formation (e.g., acidizing or cement squeezing). In FIG. 1, an upper packer 132 is shown in an un-actuated state and the lower packer 132 is shown in an actuated state to form a seal against the wall of the wellbore 108 and the production tool string 112 to prevent fluids from regions in the formation 110 below the packer 132 from interacting with the production tool string 112.

Figure 2A:
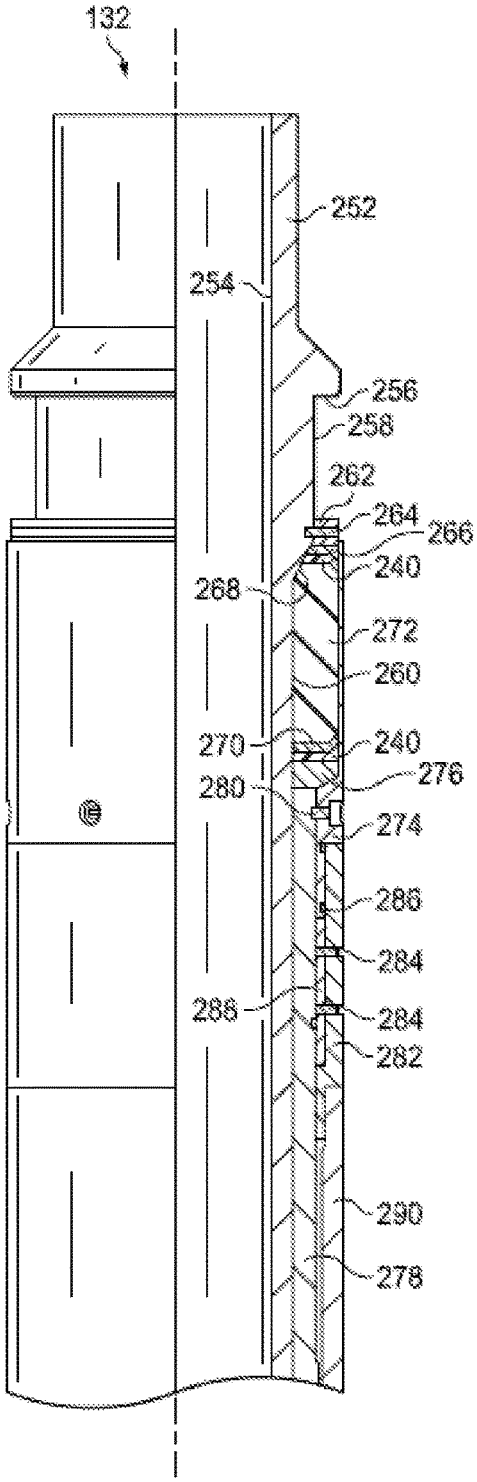
FIG. 2A is a detail view of a top portion of the packer assembly of FIG. 1 in an undeployed state, according to one embodiment.
Figure 2B:
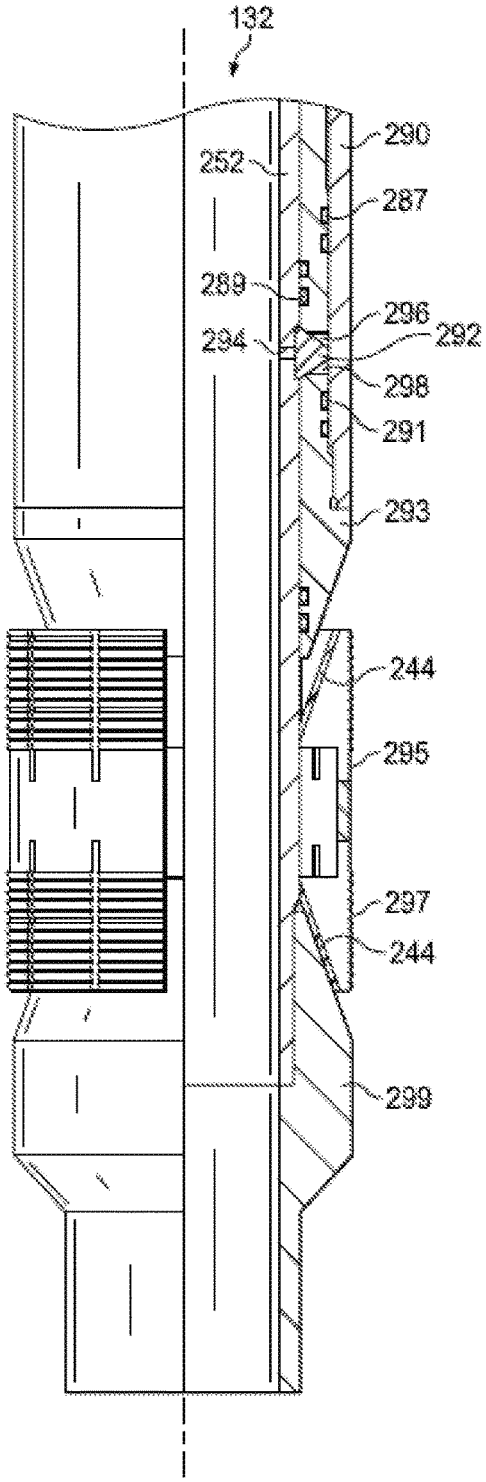
FIG. 2B is a detail view of a bottom portion of the packer assembly in an undeployed state, according to one embodiment.

A detail view of the packer 132 in the un-actuated states is shown in FIGS. 2A and 2B, with FIG. 2A showing a top portion of the packer 132 and an associated expandable sealing element and FIG. 2B showing a bottom portion of the packer 132. The packer 132 may include a tubular mandrel 252. A cylindrical conduit 254 may extend through the mandrel 252 to allow production fluids to flow through the packer 132, which functions as a portion of the production tool string 112 to transport fluids from the formation 110 for collection at the surface.

The mandrel 252 may have an outer surface of varying outer diameter, including a larger diameter portion 258 and smaller diameter portion 260. In addition, the mandrel 252 may include a stop 226, which may also be referred to as a shoulder, at the upper end of the larger diameter portion 258. An incline 268 may provide a gradual transition from the smaller diameter portion 260 to the larger diameter portion 258, and may serve as a ramp for components that move from the smaller diameter portion 260 to the larger diameter portion 258. A sheer ring 262 may be positioned around the larger diameter portion 258, and has one or more shear pins 264 that anchor the shear ring 262 to the mandrel prior to actuation of the packer 132. In an embodiment, upon actuation of the packer 132, the shear pins 264 may be operable to break in response to experiencing a critical load, and the shear ring 262 may be forced over the larger diameter portion 258 and toward the stop 256 until it contacts the stop 256. The critical load may be any desirable shear force, and may correspond to a fluid pressure in the conduit 254.

An embodiment, the upper portion of the packer 132 may include an expandable sealing element 272 that is bracketed by an upper backup shoe 266 and a lower backup shoe 270. Each of the expandable sealing element 272, upper backup shoe 266, and lower backup shoe 270 may be operable to slide from the smaller diameter portion 260 of the mandrel 252 to the larger diameter portion 258. The expandable sealing element 272 may be formed from a high-density rubber or any other suitable material. Other elastomeric materials and/or plastic materials may be used in various embodiments. A sacrificial member 240 may be included between the upper backup shoe 266 and the expandable sealing element 272, though it is noted that in other embodiments, the sacrificial member 240 may also or instead be included between the backup shoe 266 and shear ring 262.

A retaining ring 276, which may function as a movable shoulder or stop, may be included on the opposite side of the lower backup shoe 270 from the expandable sealing element 272. A second sacrificial member 240 may be included adjacent the retaining ring 276. In another embodiment, however, the sacrificial member 240 may instead be included between the retaining ring 276 and lower backup shoe 270.

Each of the sacrificial members 240 may be configured to destruct in response to an actuation signal, a critical temperature, or a critical load. The sacrificial members may be configured to destruct by melting, collapse, or disintegration upon exposure to a critical temperature or a selected axial load. The sacrificial members 240 may be configured to destruct by melting, collapse, or disintegration upon exposure to a critical temperature or a selected axial load.

In an embodiment, the second sacrificial members may be sized to have a total thickness that is approximately equal to the expected amount of thermal expansion of the components of the packer assembly that are in line with elements that move to actuate the packer 132. For example, in the portion of the packer shown in FIG. 2A, the sacrificial members 240 may have a thickness that is equal to the expected thermal expansion and the axial direction of the piston 278, retaining ring 276, lower backup shoe 270, spendable element 272, upper backup shoe 266, and shear ring 262 (or the portion of the shear 262 between the set screw 264 and the upper backup shoe 266.

In an embodiment, the sacrificial members may be formed from a material that melts at a critical temperature, where the critical temperature corresponds to a temperature at which significant thermal expansion of the packer components is expected.

In another embodiment, the sacrificial member 240 may include a dissolvable material that is selected to dissolve in the presence of a production fluid from the formation. For example, the sacrificial member 240 may be formed from an oil soluble material that dissolves after being subjected to production fluids after a certain amount of time, thereby allowing the portion of production string that includes a packer 132 to be deployed in a high temperature segment of the well before the dissolution.

In another embodiment, the sacrificial member 240 may be formed from a collapsible chamber, which may be a ring-shaped chamber that surrounds the mandrel 252 or a portion thereof. In such an embodiment, the collapsible chamber may be filled with a hydraulic fluid, and may be configured to rupture in response to being subjected to a critical load or critical temperature. For example, the collapsible chamber may be a relatively thin wall chamber that ruptures in response to being subjected to a compressive load, which may result from thermal expansion of adjacent elements. In another embodiment, the collapsible chamber may include a valve or frangible plug that ruptures in response to the hydraulic fluid reaching a critical pressure relative to the fluid pressure in the wellbore. In such embodiment, the valve may be configured to open or the frangible plug may be configured to rupture when the pressure differential reaches a critical pressure resulting from a compressive load being applied to the collapsible chamber as a result of thermal expansion of the surrounding elements. In another embodiment, the collapsible chamber may include a valve or frangible plug that is configured to open the presence of a particular fluid composition. For example, the valve or frangible plug may include an oil soluble material that dissolves or partially dissolves to open the chamber when exposed to production fluids. Exemplary materials may include, but are not limited to, naphthalene, ferrocene, and combinations thereof. The melting point of the naphthalene is approximately 176° F., which may allow for the material to melt off at approximately 200° F. Ferrocene has a melting point of approximately 342.5° F., which would allow the material to melt of at an elevated temperature of approximately 350° F. Other materials may be chosen based on their melting point and the expected operating conditions.

In another embodiment, the sacrificial member 240 may be formed from a polymer, such as a thermoplastic, that has a melting point corresponding to a critical temperature at which thermal expansion of adjacent elements in the packer 132 is expected. In such an embodiment, the sacrificial member may be formed from, for example, a naphthalene and wax composition, a rubber, a ferrocene, a polymer, or a low-melting point metal, such as tin. Tin may provide for melting off at higher temperature ranges, such as approximately 450° F. In another embodiment, the sacrificial member 240 may be formed from a reactive material that becomes reactive at temperatures at or above or critical temperature. For example, in an application in which significant thermal expansion is expected at a temperature of approximately 400° F., the reactive material may be selected to react at approximately 400° F. with an adjacent material or a chemical composition in a the wellbore in a chemical reaction that results in the destruction of the sacrificial member 240.

Referring again to the structure illustrated in FIG. 2A, to actuate the top portion of the packer 132 and compress the expandable sealing element 272, a piston 278 may be included adjacent the retaining ring 276. The piston 278 and other components of the packer 132 may be formed from any suitable material. For example, the upper backup shoe 266 and lower backup shoe 270 may be formed from a mild steel, soft brass, or any other suitable material. In addition, the upper backup shoe 266 and lower backup shoe 270 may be shaped or otherwise configured to flare away from the mandrel 258 upon actuation of the packer 132. The flaring of the upper backup shoe 266 and lower backup shoe 270 may thereby provide additional seal by engaging both the mandrel 258 and wellbore casing after actuation.

In an embodiment, a floating cover 274 may be included adjacent the expandable sealing element 272 and retained by the upper backup shoe 266 and lower backup shoe 270. The floating cover 274 may be formed from a relatively thin material so that it may easily be deformed upon actuation of the packer 132. The packer assembly 132 may further include a shear screw 280 disposed between the floating cover 274 and piston 278. Upon actuation of the packer 132, the shear screw 280 may fail and the floating cover may be freed to slide independently of the piston 278.

A locking housing 282 may be included next to and partially overlapping the floating cover 274. Additional set screws 284 may be included within the locking housing 282, and a lock ring 288 may be included between the locking housing 282 and piston 278. In addition, an elastomeric seal 286, which may be a spring-loaded O-ring, is disposed between the piston 278 and locking housing 282. In an embodiment, the floating cover 274 may extend over a portion of the locking housing 282, and one or both of the floating cover 274 and locking housing may be formed with a second region or notch so that a consistent profile is maintained along the outer surface of the packer 132. In addition, the floating cover 274 and locking housing 282 may include complementary threaded surfaces to engage one another prior to actuation of the packer 132.

In addition, the lock ring 288 may be internally threaded to include a threaded surface that complements and engages opposing external threads on the body of the mandrel 252. Engagement of such threads may help to fix the lock ring 288 relative to the mandrel 252 following actuation or setting of the packer 132. In an embodiment, the packer 132 further includes an outer cylinder 290 that surrounds the piston 278. The outer cylinder 290 may be free to slide relative to the piston 278. The outer cylinder 290 may also be threaded to engage a threaded surface on the locking housing 282, and the two components may be made to have complementary notches or other aligning features that help to maintain a common profile where the components overlap.

Referring now to FIG. 2B, in an embodiment, an actuation ring 292, which may also be referred to as a retaining ring, may be positioned at an end of the piston 278 and between the cylinder 290 and mandrel 252. The actuation ring 292 may be positioned over a port 294 that is in fluid communication with the conduit 254. A void 296 may be formed between the surfaces of the actuation ring 292, the piston 278, the mandrel 252, and the cylinder 290. Similarly, a second void 298 may be formed by the surfaces of the mandrel 252, a wedge member 293, the actuation ring 292, and the cylinder 290.

Additional O-rings 287, 289, 291 or other seals may be installed, respectively, between (i) the piston 278 and cylinder 290, (ii) the wedge member 293 and cylinder 290, and (iii) piston 278 and mandrel 252 to provide fluidly sealed interfaces. In the embodiment illustrated in FIGS. 2-3, the chambers 296 and 298 are fluidly coupled by a lifting ring 292 when the packer 132 is actuated, at which point the chambers 296 and 298 are opened to one another. In an embodiment, the lifting ring 292 may include a fluid opening so that the chambers 296 and 298 are also in fluid equilibrium with one another prior to actuation of the packer 132. As further described in more detail below with regard to FIG. 3, the chambers 296 and 298 are configured to expand upon actuation of the packer 132.

The wedge member 293 may be positioned to slide along the outer surface of the mandrel 252 at a preselected distance below lifting ring 292 and coupled to the cylinder 290 by a threaded coupling. Wedge member 293 may have an inclined, or cammed outer surface that engages a complementary cammed surface of a slip assembly 295 upon actuation of the packer 132.

The slip assembly 295 may provide an additional expanding surface that engages the well casing or wellbore wall upon actuation of the packer 132, and is located between wedge member 293 and a lower wedge portion 299 of the packer 132. In an embodiment, the outer surfaces of the slip assembly 295 may include teeth 297 or a roughed surface along its outer surface to grip the interior of the well casing or wellbore wall. Upon actuation of the packer 132, a compressive force may be generated between wedge member 293, slip assembly 295, and lower wedge portion 299, that causes the slip assembly to expand radially within the well casing.

Like the elements of the packer 132 described above with regard to the expandable sealing element 272, the slip assembly is also engaged by a compressive force generated by elements of the packer assembly being compressed together. These elements may also be subject to thermal expansion upon exposure to very high temperatures within the well. As such, additional sacrificial members 244 may be included to decrease the risk of premature setting of the packer 132 resulting from thermal expansion. In the embodiment shown in FIG. 2B, the additional sacrificial members 244 may be included between the slip assembly 295 and upper wedge member 293, and between the slip assembly 292 and lower wedge portion 299.

The additional sacrificial members 244 may function substantially the same as the sacrificial members 240 described above with regard to FIG. 2A. In an embodiment, the additional sacrificial members 244 may be sized and configured to occupy an axial distance that is equivalent to the expected amount of thermal expansion (in the axial direction) of interacting elements of the packer. For example, in response to exposure to extremely high temperatures, the slip assembly 295 and lower wedge portion 299 may under thermal expansion that would result in the slip assembly 295 being forced radially outward as the inclined surfaces of the slip assembly 295 and lower wedge portion are forced together. The effects of such thermal expansion may be counteracted by including an additional sacrificial member 244 between the inclined surfaces of the slip assembly 295 and lower wedge portion 299. The expected axial thermal expansion of the slip assembly 295 and lower wedge portion 299 may be estimated, and the sacrificial element may be formed to have a thickness, in the axial direction that is approximately equal to the estimated amount of expansion. Similarly, additional sacrificial members 244 may be included between the upper wedge member 293 and slip 295 assembly, or between elements of the slip assembly 295 to offset expected thermal expansion of such elements.

Figure 3A:
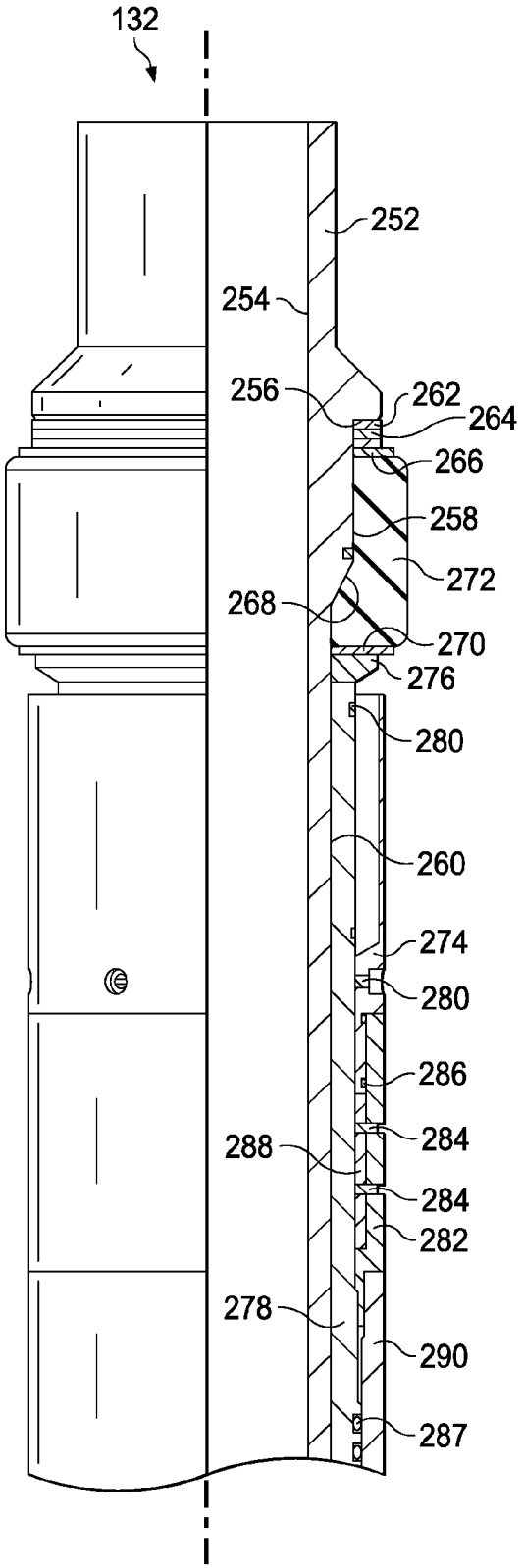
FIG. 3A is a detail view of the top portion of the packer assembly in a deployed state, according to one embodiment.
Figure 3B:
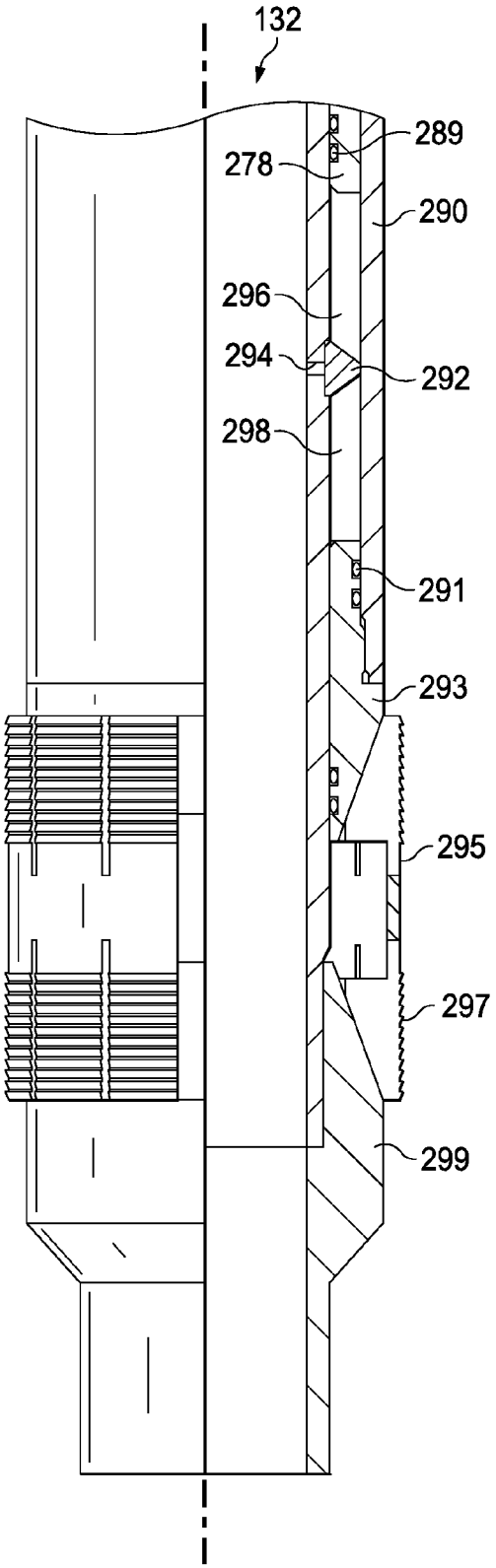
FIG. 3B is a detail view of the bottom portion of the packer assembly in a deployed state, according to one embodiment.

Again, it is noted that FIGS. 2A and 2B show the packer 132 in its pre-actuated state. The packer 132 generally remains in the pre-actuated state as it is run into the wellbore for installation and until the packer is actuated and set within the wellbore. In the pre-actuated state, the floating cover 274 is positioned to cover the expandable sealing element 272 and attached to the piston 278 by the shear screw 280. Upon actuation the expandable sealing element 272 and slip assembly 295 extend radially to engage and form a seal against the well casing or wellbore wall, as shown in FIGS. 3A and 3B. In FIGS. 3A and 3B, the packer 132 has been deployed in a high temperature well and the sacrificial members 240 and additional sacrificial members 244 have been destroyed using any of the methods of destruction described above.

In an embodiment, the packer 132 may be actuated by an increase in pressure within the conduit 254 to a critical pressure that causes the port 294 to open by displacing the lifting ring 292. A ball valve, flapper valve, plug, or similar device may be positioned downhole of the port 94 to cause a buildup of pressure in the conduit 254 to a pressure that equals or exceeds the critical pressure. In an embodiment, the pressure needed to actuate the packer 132 may be supplied by, for example, a surface pump.

Increasing the fluid pressure supplied to the port 294 may cause fluid in the port 294 to lift the lifting ring 292 and supplies fluid pressure to the chambers 296, 298. The application of such fluid pressure may cause fluid in the chambers 296, 298 to generate an upward force on the piston 278 and a downward force on the wedge member 293, which is coupled to the cylinder 290.

The shear screw 280 may initially oppose relative movement between the piston 278 and cylinder 290. However, the piston 278 and cylinder 290 may be free to move relative to one another when the force applied to the piston 278 exceeds the critical force necessary to shear the shear screw 280. Shearing of the shear screw 280 may enable the pressurized fluid within chamber 298 to generate a downward force that causes the wedge member 293 and cylinder 290 to move towards the slip assembly 295. As it moves downward, the wedge member 293 may engage the slip assembly 295, causing the slip assembly 295 to move downward over the lower wedge portion 299. The compressive forces applied to the slip assembly 295 by the lower wedge portion 299 and wedge member 293 may cause the slip assembly 295 to extend radially to engage the inner surface of the well casing or wellbore wall. Once the slip assembly 295 reaches the end of its travel and is set against the well casing or wellbore wall, fluid pressure in first chamber 296 may result in an increase force to the piston 278, which shears the shear screw 264 when the force on the piston 278 reaches a critical force.

Following shearing of the shear screw 264, the piston 278 may apply an upward force to the retaining ring 276 and lower backup shoe 270 to move the expandable sealing element 272 upward relative to mandrel 252, from under the floating cover 274, which may have moved downward with the wedge member 293 and cylinder 290, and over the larger diameter portion 258 of the mandrel 252.

The shear ring 262 may be forced upward by the expandable sealing element 272 until it contacts the stop 256 of the mandrel 252 when the expandable sealing element 272 may be forced upward and over the larger diameter portion 258. As the expandable sealing element 272 moves over the larger diameter portion 258 of the mandrel 252, the expandable sealing element 272 may seal against the well casing or wellbore wall to form a fluid seal. As the expandable sealing element 272 expands, the upper backup shoe 266 and lower backup shoe 270 may flare outward toward the casing or wellbore wall to provide a metal seal in addition to the seal of expandable sealing element 272, as shown in FIGS. 3A-3B. After the expandable sealing element 272 has been urged over the larger diameter portion 258 of the mandrel 252 to form a seal, the lock ring 288 may prevent further relative movement between the piston 278 and cylinder 290, thereby locking the piston 278, retaining ring 276, expandable sealing element 272, and upper backup shoe 266 in place.

In an embodiment, the use of the sacrificial members 240 and additional sacrificial members 244 to occupy a volume of anticipated thermal expansion may help to prevent elements or components of the packer from prematurely engaging one another causing with the expandable sealing element 272 of slip assembly 295 to undergo all or a portion of the setting process prior to actuation of the packer.

It is noted that while the packer 132 is described as an exemplary system in which the sacrificial members 240, 244 may be used, sacrificial members may be included in any tool string element that is expected to generate compressive forces as a result of thermal expansion of elements or certain elements expanding at a greater rate than other elements included an assembly. One or more sacrificial members may be placed between or adjacent elements of a tool or tool string that is expected to deform when subjected to high temperatures as a result of thermal expansion. The sacrificial members are configured to destruct upon exposure to a control signal or a critical temperature or load in accordance with any of the modes of destruction described above. Destruction of the sacrificial members provides additional clearance for adjacent or in-line elements to expand while still providing an assembly that is rigid with little or now open spaces under atmospheric conditions.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

The illustrative systems, methods, and devices described herein may also be described by the following examples:

Example 1

A packer assembly comprising:

a slip assembly having a cammed surface;

an actuator subassembly having a cammed actuation surface that engages the cammed surface of the slip assembly to actuate the slip assembly; and a sacrificial member disposed between the cammed surface of the slip assembly and the cammed actuation surface.

Example 2

The packer assembly of Example 1, wherein the sacrificial member has a linear thickness that is approximately equivalent to a linear displacement resulting from thermal expansion of the cammed surface of the slip assembly and the actuator subassembly.

Example 3

The packer assembly of Example 1, wherein the slip assembly further comprises a second cammed surface, and wherein the packer assembly further comprises:

a stationary cammed surface that engages the second stationary cammed surface upon actuation of the slip assembly; and a second sacrificial member disposed between the second cammed surface and the stationary cammed surface.

Example 4

The packer assembly of Example 3, wherein the second sacrificial member has a linear thickness that is approximately equivalent to a linear displacement resulting from thermal expansion of the second cammed surface of the slip assembly and the stationary cammed surface.

Example 5

The packer assembly of Example 1, wherein the sacrificial member comprises a dissolvable material.

Example 6

The packer assembly of Example 5, wherein the dissolvable material is oil soluble.

Example 7

The packer assembly of Example 1, wherein the sacrificial member comprises a collapsible chamber having a hydraulic fluid and a dissolvable plug.

Example 8

The packer assembly of Example 7, wherein the dissolvable plug comprises an oil soluble material.

Example 9

The packer assembly of Example 1, wherein the sacrificial member comprises a thermoplastic.

Example 10

The packer assembly of Example 1, wherein the sacrificial member comprises at least one reactive material, wherein the reactive material becomes reactive at temperatures above or equal to approximately 400° F.

Example 11

The packer assembly of Example 10, wherein the sacrificial member comprises a material selected from the group consisting of: a naphthalene and wax, a rubber, and a ferrocene.

Example 12

A packer assembly comprising:

an expandable sealing element;

a compressive actuator that compresses the expandable sealing element to actuate the packer assembly; and a sacrificial member disposed between the expandable sealing element and the compressive actuator.

Example 13

The packer assembly of Example 12, wherein the sacrificial member has a linear thickness that is approximately equivalent to a linear displacement resulting from thermal expansion of the packer assembly.

Example 14

The packer assembly of Example 12, wherein the sacrificial member comprises a dissolvable material.

Example 15

The packer assembly of Example 14, wherein the dissolvable material is oil soluble.

Example 16

The packer assembly of Example 12, wherein the sacrificial member comprises a collapsible chamber having a hydraulic fluid and a dissolvable plug.

Example 17

The packer assembly of Example 16, wherein the dissolvable plug comprises an oil soluble material.

Example 18

The packer assembly of Example 12, wherein the sacrificial member comprises a thermoplastic.

Example 19

The packer assembly of Example 12, wherein the sacrificial member comprises at least one reactive material, wherein the reactive material becomes reactive at temperatures above or equal to approximately 400° F.

Example 20

The packer assembly of Example 19, wherein the sacrificial member comprises a material selected from the group consisting of: a naphthalene and wax, a rubber, and a ferrocene.

Example 21

An isolation system comprising:

an expandable sealing element;

a compressive actuator that compresses the expandable sealing element upon actuation;

a first sacrificial member disposed between the expandable sealing element and the compressive actuator;

a slip assembly having a cammed surface;

a second actuator having a cammed actuation surface that engages the cammed surface of the slip assembly upon actuation; and a second sacrificial member disposed between the cammed surface of the slip assembly and the cammed actuation surface.

Example 22

The isolation system of Example 21, wherein compressive actuator and second actuator are initiated by a hydraulic control signal.

Example 23

The isolation system of Example 22, wherein compressive actuator and second actuator are fluidly coupled to a wellbore, and wherein the hydraulic control signal comprises an increase in fluid pressure in the wellbore to a preselected pressure.

Example 24

The isolation system of Example 21, wherein the first sacrificial member and second sacrificial member comprise a dissolvable material.

Example 25

The isolation system of Example 24, wherein the dissolvable material is oil soluble.

Example 26

The isolation system of Example 21, wherein the first sacrificial member and second sacrificial member comprise a collapsible chamber having a hydraulic fluid and a dissolvable plug.

Example 27

The isolation system of Example 26, wherein the dissolvable plug comprises an oil soluble material.

Example 28

The isolation system of Example 21, wherein the first sacrificial member and second sacrificial member comprise a thermoplastic.

Example 29

The isolation system of Example 21, wherein the first sacrificial member and second sacrificial member comprise at least one reactive material, wherein the reactive material becomes reactive at temperatures above or equal to approximately 400° F.

Example 30

The isolation system of Example 21, wherein the first sacrificial member and first second member comprise a material selected from the group consisting of: a naphthalene and wax, a rubber, and a ferrocene.

Example 31

An isolation method comprising:
providing an isolation system comprising:
an expandable sealing element;
a compressive actuator; and
a first sacrificial member disposed between the expandable sealing element and the compressive actuator; and
actuating the compressive actuator to compress the expandable sealing element; and
allowing the first sacrificial member to destruct.

Example 32

The isolation method of Example 31, further comprising:
providing a packer assembly comprising:
a slip assembly having a cammed surface;
a second actuator having a cammed actuation surface; and
a second sacrificial member disposed between the cammed surface of the slip assembly and the cammed actuation surface; and
actuating the second actuator to engage the cammed actuation surface with the cammed surface of the slip assembly; and
allowing the second sacrificial member to destruct.

Example 33

The isolation method of Example 31, wherein compressive actuator and second actuator are initiated by a hydraulic control signal.

Example 34

The isolation method of Example 33, wherein compressive actuator and second actuator are fluidly coupled to a wellbore, and wherein the hydraulic control signal comprises an increase in fluid pressure in the wellbore to a preselected pressure.

Example 35

The isolation method of Example 31, wherein the first sacrificial member and second sacrificial member comprise a dissolvable material.

Example 36

The isolation method of Example 35, wherein the dissolvable material is oil soluble.

Example 37

The isolation method of Example 31, wherein the first sacrificial member and second sacrificial member comprise a collapsible chamber having a hydraulic fluid and a dissolvable plug.

Example 38

The isolation method of Example 37, wherein the dissolvable plug comprises an oil soluble material.

Example 39

The isolation method of Example 31, wherein the first sacrificial member and second sacrificial member comprise a thermoplastic.

Example 40

The isolation method of Example 31, wherein the first sacrificial member and second sacrificial member comprise at least one reactive material, wherein the reactive material becomes reactive at temperatures above or equal to approximately 400° F.

Example 41

The isolation method of Example 31, wherein the first sacrificial member and first second member comprise a material selected from the group consisting of: a naphthalene and wax, a rubber, and a ferrocene.

It will be understood that the above description of the embodiments is given by way of example only and that various modifications may be made by those skilled in the art. The above specification, examples, and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the scope of the claims.

I claim:

1. A packer assembly comprising:

a slip assembly comprising a cammed surface;

a wedge member comprising a cammed outer surface, the wedge member being slidable in an axial direction to engage the cammed surface of the slip assembly to actuate the slip assembly; and a sacrificial member extending across the cammed surface of the slip assembly and disposed between the cammed surface of the slip assembly and the cammed outer surface of the wedge member, the sacrificial member having a linear thickness that is approximately equivalent to a linear displacement resulting from thermal expansion of the cammed surface of the slip assembly and the wedge member and being configured to destruct to provide a void between the cammed surface of the slip assembly and the cammed outer surface of the wedge member.

2. The packer assembly of claim 1, wherein the slip assembly further comprises a second cammed surface, and wherein the packer assembly further comprises:

a stationary cammed surface, wherein the second cammed surface movable upon actuation of the slip assembly to engage the stationary cammed surface; and a second sacrificial member disposed between the second cammed surface and the stationary cammed surface.

3. The packer assembly of claim 2, wherein the second sacrificial member has a linear thickness that is approximately equivalent to a linear displacement resulting from thermal expansion of the second cammed surface of the slip assembly and the stationary cammed surface.

4. The packer assembly of claim 1, wherein the sacrificial member comprises a dissolvable material.

5. The packer assembly of claim 1, wherein the sacrificial member comprises a thermoplastic.

6. The packer assembly of claim 1, wherein the sacrificial member comprises a material that results in the destruction of the sacrificial member at a temperature of approximately 400° F. to approximately 450° F.

7. The packer assembly of claim 1, wherein the sacrificial member extends parallel to the cammed surface of the slip assembly and the cammed outer surface of the wedge member.

8. A packer assembly comprising:

an expandable sealing element;

a compressive actuator configured to compress the expandable sealing element to actuate the packer assembly; and a sacrificial member disposed between and extending parallel to the expandable sealing element and the compressive actuator, the sacrificial member having a thickness that is approximately equivalent to the total thermal expansion of the packer assembly along an axial direction and being configured to destruct to provide a void between the expandable sealing element and the compressive actuator.

9. The packer assembly of claim 8, wherein the sacrificial member comprises a dissolvable material.

10. The packer assembly of claim 8, wherein the sacrificial member comprises a thermoplastic.

11. The packer assembly of claim 8, wherein the sacrificial member comprises a material that results in the destruction of the sacrificial member at a temperature of approximately 400° F. to approximately 450° F.

12. An isolation method comprising:

providing an isolation system comprising:

an expandable sealing element;

a compressive actuator; and a first sacrificial member disposed between and extending parallel to the expandable sealing element and the compressive actuator, the sacrificial member having a thickness that is approximately equivalent to the total thermal expansion of the packer assembly along an axial direction;

actuating the compressive actuator to compress the expandable sealing element; and destructing the first sacrificial member to provide a void between the expandable sealing element and the compressive actuator.

13. The isolation method of claim 12, further comprising:

providing a packer assembly comprising:

a slip assembly comprising a cammed surface;

a second actuator comprising a cammed outer surface, the second actuator being slidable in the axial direction to engage the cammed surface of the slip assembly to actuate the slip assembly; and a second sacrificial member disposed between the cammed surface of the slip assembly and the cammed outer surface;

actuating the second actuator to engage the cammed outer surface with the cammed surface of the slip assembly; and allowing the second sacrificial member to destruct.

14. The isolation method of claim 13, wherein the first sacrificial member and the second sacrificial member comprise a dissolvable material.

15. The isolation method of claim 13, wherein the first sacrificial member and the second sacrificial member comprise a thermoplastic.

16. The isolation method of claim 13, wherein the first sacrificial member and the second sacrificial member comprise a material that results in the destruction of the sacrificial member at a temperature of approximately 400° F. to approximately 450° F.

* * * * *